US008566984B2

(12) United States Patent
Paz et al.

(10) Patent No.: US 8,566,984 B2
(45) **Date of Patent: *Oct. 29, 2013**

(54) MULTI-POSITION SUPPORT APPARATUS FEATURING A MOVABLE FOOT SUPPORT

(76) Inventors: Ohad Paz, Tel-Aviv (IL); Ofer Parezky, Nes Ziona (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,486

(22) Filed: Feb. 13, 2012

(65) Prior Publication Data

US 2012/0137437 A1 Jun. 7, 2012

Related U.S. Application Data

(63) Continuation-in-part of application No. 11/715,410, filed on Mar. 8, 2007, now Pat. No. 8,117,695, which is a continuation-in-part of application No. PCT/IL2006/000575, filed on May 16, 2006, which is a continuation-in-part of application No. 11/130,130, filed on May 17, 2005, now abandoned, which is a continuation-in-part of application No. 11/130,129, filed on May 17, 2005, now abandoned.

(60) Provisional application No. 60/715,177, filed on Sep. 9, 2005, provisional application No. 60/715,147, filed on Sep. 9, 2005, provisional application No. 60/738,592, filed on Nov. 22, 2005.

(51) Int. Cl.
*A47B 7/02* (2006.01)

(52) U.S. Cl.
USPC ..... 5/618; 5/610; 5/624

(58) Field of Classification Search
USPC ..... 5/611, 604, 610, 624, 618
See application file for complete search history.

(56) References Cited

U.S. PATENT DOCUMENTS

| | | | | |
|---|---|---|---|---|
| 3,997,926 | A | 12/1976 | England | |
| 4,685,159 | A | 8/1987 | Oetiker | |
| 4,724,554 | A | 2/1988 | Kowalski et al. | |
| 4,724,555 | A | 2/1988 | Poehner et al. | |
| 5,023,967 | A | 6/1991 | Ferrand | |
| 5,195,531 | A | 3/1993 | Bennett | |
| 5,230,113 | A | 7/1993 | Foster et al. | |
| 5,366,036 | A * | 11/1994 | Perry | 180/65.1 |
| 5,638,563 | A | 6/1997 | Iura | |
| 6,101,646 | A | 8/2000 | Son | |

(Continued)

FOREIGN PATENT DOCUMENTS

WO WO 2006/123333 11/2006

OTHER PUBLICATIONS

Advisory Action Before the Filing of an Appeal Brief Dated Jun. 9, 2011 From the US Patent and Trademark Office Re.: U.S. Appl. No. 12/542,913.

(Continued)

*Primary Examiner* — William Kelleher
*Assistant Examiner* — Richard G Davis

(57) ABSTRACT

Apparatus for supporting a user in a resting position characterized in that it includes a processor programmed to cause a foot support to be in a feet-engaging position, engaging the bottom surface of the user's feet, when a tiltable frame assembly is in a resting position, and to maintain the feet-engaging position while the tiltable frame assembly is moving towards a vertical position, to thereby prevent sliding of the user's body when the tiltable frame assembly is tilted.

7 Claims, 11 Drawing Sheets

(56) References Cited

U.S. PATENT DOCUMENTS

| | | | | |
|---|---|---|---|---|
| 6,131,868 | A | 10/2000 | Welling | |
| 6,781,517 | B2 | 8/2004 | Moster et al. | |
| 6,862,762 | B1 * | 3/2005 | Johnson et al. | 5/601 |
| 6,912,746 | B2 * | 7/2005 | Grove | 5/618 |
| 7,058,999 | B2 | 6/2006 | Horitani | |
| 7,296,312 | B2 | 11/2007 | Menkedick et al. | |
| 8,028,359 | B2 * | 10/2011 | Parson et al. | 5/619 |
| 2004/0004559 | A1 | 1/2004 | Rast | |
| 2004/0210155 | A1 | 10/2004 | Takemura | |
| 2004/0221391 | A1 * | 11/2004 | Allen et al. | 5/624 |
| 2005/0172405 | A1 * | 8/2005 | Menkedick et al. | 5/618 |
| 2006/0260051 | A1 | 11/2006 | Paz | |
| 2007/0169267 | A1 | 7/2007 | Paz et al. | |
| 2009/0300845 | A1 | 12/2009 | Paz et al. | |

OTHER PUBLICATIONS

Advisory Action Before the Filing of an Appeal Brief Dated Apr. 18, 2011 From the US Patent and Trademark Office Re.: U.S. Appl. No. 11/715,410.

Dismissed Petition Dated Aug. 18, 2011 From the US Patent and Trademark Office Re. U.S. Appl. No. 11/715,410.

Dismissed Petition Dated Aug. 18, 2011 From the US Patent and Trademark Office Re.: U.S. Appl. No. 12/542,913.

International Preliminary Report on Patentability Dated Nov. 19, 2007 From the International Bureau of WIPO Re. Application No. PCT/IL2006/000575.

Interview Summary Dated Jul. 26, 2011 From the US Patent and Trademark Office Re.: U.S. Appl. No. 11/715,410.

Notice of Allowance Dated Nov. 1, 2011 From the US Patent and Trademark Office Re.: U.S. Appl. No. 11/715,410.

Notice of Allowance Dated Sep. 29, 2011 From the US Patent and Trademark Office Re.: U.S. Appl. No. 12/542,913.

Notice of Appeal Dated Aug. 15, 2011 to Official Action of Apr. 4, 2011 From the US Patent and Trademark Office Re.: U.S. Appl. No. 12/542,913.

Notice of Appeal Dated Aug. 15, 2011 to Official Action of Feb. 14, 2011 From the US Patent and Trademark Office Re.: U.S. Appl. No. 11/715,410.

Official Action Dated Apr. 3, 2009 From the US Patent and Trademark Office Re.: U.S. Appl. No. 11/715,410.

Official Action Dated Apr. 4, 2011 From the US Patent and Trademark Office Re.: U.S. Appl. No. 12/542,913.

Official Action Dated Dec. 5, 2008 From the US Patent and Trademark Office Re.: U.S. Appl. No. 11/715,410.

Official Action Dated Feb. 14, 2011 From the US Patent and Trademark Office Re.: U.S. Appl. No. 11/715,410.

Official Action Dated Feb. 16, 2010 From the US Patent and Trademark Office Re.: U.S. Appl. No. 11/715,410.

Official Action Dated May 18, 2010 From the US Patent and Trademark Office Re.: U.S. Appl. No. 12/542,913.

Official Action Dated Nov. 23, 2009 From the US Patent and Trademark Office Re.: U.S. Appl. No. 11/715,410.

Official Action Dated Aug. 26, 2010 From the US Patent and Trademark Office Re.: U.S. Appl. No. 11/715,410.

Official Action Dated Sep. 27, 2010 From the US Patent and Trademark Office Re.: U.S. Appl. No. 12/542,913.

Response Dated Jan. 4, 2009 to Official Action of Dec. 5, 2008 From the US Patent and Trademark Office Re.: U.S. Appl. No. 11/715,410.

Response Dated Jul. 5, 2011 to Official Action of Apr. 4, 2011 From the US Patent and Trademark Office Re.: U.S. Appl. No. 12/542,913.

Response Dated May 10, 2010 to Official Action of Nov. 23, 2009 From the US Patent and Trademark Office Re.: U.S. Appl. No. 11/715,410.

Response Dated Oct. 10, 2011 to Notice of Appeal of Aug. 15, 2011 to Official Action of Feb. 14, 2011 From the US Patent and Trademark Office Re.: U.S. Appl. No. 11/715,410.

Response Dated Apr. 12, 2011 to Official Action of Feb. 14, 2011 From the US Patent and Trademark Office Re.: U.S. Appl. No. 11/715,410.

Response Dated Oct. 18, 2010 to Official Action of May 18, 2010 From the US Patent and Trademark Office Re.: U.S. Appl. No. 12/542,913.

Response Dated Jan. 21, 2010 to Official Action of Nov. 23, 2009 From the US Patent and Trademark Office Re.: U.S. Appl. No. 11/715,410.

Response Dated Sep. 22, 2011 to Official Action of Apr. 4, 2011 From the US Patent and Trademark Office Re.: U.S. Appl. No. 12/542,913.

Response Dated Nov. 24, 2010 to Official Action of Aug. 26, 2010 From the US Patent and Trademark Office Re.: U.S. Appl. No. 11/715,410.

Response Dated May 26, 2011 to Official Action of Apr. 4, 2011 From the US Patent and Trademark Office Re.: U.S. Appl. No. 12/542,913.

Response Dated Dec. 27, 2010 to Official Action of Sep. 27, 2010 From the US Patent and Trademark Office Re.: U.S. Appl. No. 12/542,913.

Response Dated Jul. 31, 2009 to Official Action of Apr. 3, 2009 From the US Patent and Trademark Office Re.: U.S. Appl. No. 11/715,410.

* cited by examiner

MULTI-POSITION SUPPORT APPARATUS FEATURING A MOVABLE FOOT SUPPORT

RELATED APPLICATIONS

This application is a continuation-in-part of U.S. patent application Ser. No. 11/715,410, filed on Mar. 8, 2007, now U.S. Pat. No. 8,117,695 which is a continuation-in-part (CIP) of PCT Patent Application No. PCT/IL2006/000575 filed on May 16, 2006, which is a continuation-in-part (CIP) of U.S. patent application Ser. Nos. 11/130,129 and 11/130,130, both filed on May 17, 2005 and now abandoned, and which claims the benefit of priority from U.S. Provisional Patent Application Nos. 60/715,147 and 60/715,177, both filed on Sep. 9, 2005, and 60/738,592, filed on Nov. 22, 2005.

This application is also related to PCT Patent Application No. PCT/IL2006/000574 filed on May 16, 2006.

The contents of all of the above applications are incorporated by reference as if fully set forth herein.

FIELD OF THE INVENTION

The embodiments of the present invention relate to supporting apparatus and, more particularly, to multi-position support apparatus for supporting a user in a manner facilitating the exiting of the user from the apparatus.

BACKGROUND

Apparatus is known for supporting a user in a resting position and/or a vertical exiting position, including: a tiltable frame assembly tiltably mounted on a base; a body support carried by the tiltable frame assembly and having a head end for receiving the upper part of the user's body, and a foot end for receiving the lower part of the user's body; a foot support extending transversely across the foot end of the body support; and drive means for driving the tiltable frame assembly to the resting position and to the substantially vertical exiting position.

In the known apparatus of this type, the foot support is movable with respect to the body support in order to accommodate different size users. The present invention utilizes the foot support for a different purpose, namely to facilitate a sick or elderly user to exit from the apparatus, as will be described more particularly below.

To date, the inventor is unaware of prior art teaching of a multi-position support apparatus utilizing the foot support to faciliate exiting from the apparatus.

There is thus a need for, and it would be highly advantageous to have a multi-position support apparatus featuring a movable foot support.

BRIEF SUMMARY

According to a broad aspect of the present invention, there is provided apparatus for supporting a user in a resting position and a vertical exiting position, characterized in that the apparatus further includes a processor programmed to cause the foot support to be in a feet-engaging position, engaging the bottom surface of the user's feet, when the tiltable frame assembly is in the resting position, and to maintain the feet-engaging position while the tiltable frame assembly is moving towards the vertical exiting position, to thereby prevent sliding of the user's body when exiting from the apparatus.

The embodiments of the present invention are readily implemented using standard hardware components and standard software modules. Moreover, the embodiments are generally applicable as a 'stand-alone' multi-position support apparatus, or as a multi-position support apparatus used in combination with other methods, devices, and systems, performing various operations. In one described embodiment, the body support is movable relative to the foot support, and in another described embodiment, the foot support is movable relative to the body support.

Implementation of the multi-position support apparatus embodiments involves performing or completing selected tasks or steps manually, semi-automatically, fully automatically, and/or a combination thereof. Moreover, depending upon actual instrumentation and/or equipment used for implementing a particular embodiment of the disclosed system and corresponding method, several embodiments could be achieved by hardware, by software on any operating system of any firmware, or a combination thereof. In particular, as hardware, embodiments of the invention could exist by variations in the physical structure. Additionally, or alternatively, as software, selected functions of the invention could be performed by a data processor, such as a computing platform, executing a of computer program types of software instructions or protocols using any suitable computer operating system.

BRIEF DESCRIPTION OF THE DRAWINGS

The embodiments of the present invention are herein described, by way of example only, with reference to the accompanying drawings. With specific reference now to the drawings, it is stressed that the particulars shown are by way of example and for purposes of illustrative discussion of the embodiments of the present invention only, and are presented in order to providing what is believed to be the most useful and readily understood description of the principles and conceptual aspects of the embodiments. In this regard, no attempt is made to show structural details of the embodiments in more detail than is necessary for a fundamental understanding of the invention, the description taken with the drawings making apparent to those skilled in the art how the several forms of the invention may be embodied in practice. In the drawings.

DETAILED DESCRIPTION

The embodiments of the present invention relate to supporting apparatus and, more particularly, to multi-position support apparatus featuring a movable foot support.

The embodiments of the present invention are not limited by the details of the order or sequence of steps of operation or implementation of the methods and/or the details of construction, arrangement, and composition of the components of the devices set forth in the following description, drawings or examples. While specific steps, configurations and arrangements are discussed, it is to be understood that this is done for illustrative purposes only. A person skilled in the relevant art will recognize that other steps, embodiments, configurations and arrangements may be used without departing from the spirit and scope of the embodiments of the present invention.

The embodiments of the present invention are capable of other embodiments or of being practiced or carried out in various ways. Also, it is to be understood that the phraseology, terminology and notation employed herein are for the purpose of description and should not be regarded as limiting.

Elderly people have difficulty bending over and moving from a standing position to a sitting position, and vice versa. People with severe knee problems also have difficulty bending their knees. As a result, the action of sitting down on a bed is difficult for them. Overweight and/or obese people sometimes find it difficult to bend their knees when sitting down on a bed, and have difficulty rising up from a bed.

For consistency, hereinbelow the terms "bed", "multi-position bed" and "multi-position support apparatus" should have the same meaning. Also the term "engine", "drive" or "driving means" refers to any device, or combination of devices, including electrical or hydraulic motors and actuators, which move another device or combination of devices.

The multi-position support apparatus receives and lowers the user from a standing position (while both the bed and user are about vertical), into a reclining or horizontal position, optionally without having to tie and/or secure the user to the bed before the angular position change occurs. Then, when the user wants to get out of bed, the bed raises the user from lying down to standing up.

The multi-position support apparatus may include wheels which enable the bed to move and which may be motorized to control the movement of the bed using a control panel. The control panel may allow the user to operate the different engines separately, and/or to perform complete operations such as transition from a standing position to a sitting position and vice versa, transition from a standing position to a lying position and vice versa, and transition from a sitting position to a lying position and vice versa. The control panel may also allow the user to stop the multi-position support apparatus in any of the intermediate states of the above described complete operations.

Figure 1:
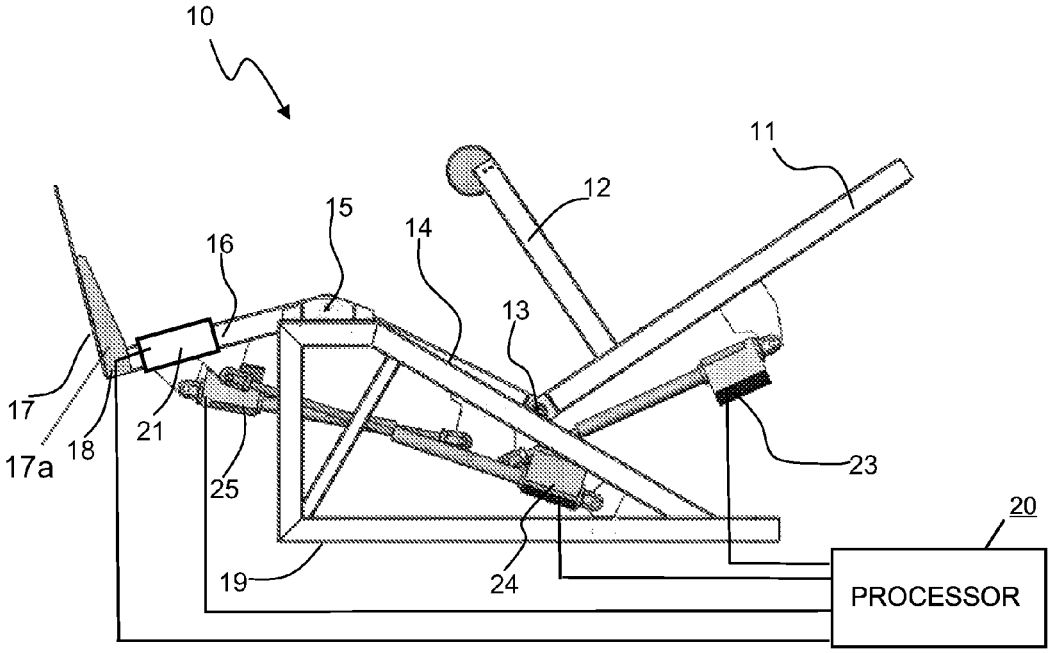
FIG. 1 is a schematical illustration of a multi-position support apparatus in accordance with the present invention.

Referring to the drawings, FIG. 1 schematically illustrates the basic components of an apparatus 10 constructed in accordance with this invention, comprising a tiltable frame assembly including a body support having a head section 11, a seat section 14, and a leg section 16 at the foot end 18 of the body support, all mounted on a base 19. The illustrated apparatus further includes a foot support 17 constituted of a member extending transversely across the foot end 18 of the body support. In these embodiments, relative movement is effected between the foot support 17 and the foot end 18 of the body support such that the foot support 17 is brought into engagement with the bottom surfaces of the user's feet to prevent the user from sliding as the bed shifts from a lying position to a standing position and/or when the bed shifts from a sitting position to a standing position. Thus, when the user wishes to stand up from lying down or sitting, the foot support 17 effectively moves toward the head of the bed until it reaches the user's feet, to prevent sliding of the user on the body support and thereby to facilitate exiting from the apparatus. Also schematically illustrated in FIG. 1 is a processor 20 which is programmed to control the drive means, schematically shown in FIG. 1 as including electrical devices 21, 23, 24 and/or 25, for performing the foregoing operations, as well as those discussed below.

Detecting when the foot support has reached the feet of the user lying in the bed may be achieved in various ways, such as, but not limited to, using a pressure sensor, schematically shown at 17*a* in FIG. 1, that measures the user's legs intensity of the resistance and inputs such measurement into processor 20 to control the drive means in accordance therewith. The minimal threshold of intensity measured by the sensor should be set to a value that is high enough to ensure that the movable foot support 17 has actually reached the user's feet, and not another object that may be on the bed. For example this feature would serve as a safety precaution, wherein the user is not brought to a standing position while stepping on a blanket or a pillow.

However, if the user purposely wants to be brought to a standing position while stepping on a blanket or a pillow, the pressure sensor should be configured and set to ensure that a minimal predefined amount of pressure is applied, implying that the object is pressed to the user's feet. Only when the appropriate amount of pressure is measured by the sensor, the bed begins to rise to a standing position.

For example, if the user wishes to shift from a lying position to a sitting position, it is possible to enable the bed to begin moving when the amount of pressure measured by the sensor is smaller than the predefined amount of pressure required for beginning the shifting from a lying position to a standing position.

In the latter example, if the user wishes to be brought to a standing position, the multi-position support apparatus may be programmed to change its angular position simultaneously while the foot support moves towards the direction of the head of the multi-position support apparatus. Performing these two actions simultaneously saves time and does not endanger the user, as long as movable foot support 17 reaches the user's feet in a reasonable amount of time in relation to the angular position of the multi-position support apparatus.

Also when the multi-position support apparatus starts to recline from its standing position, the foot support may be raised before its angular position is changed in order to prevent a situation wherein the back edge of the foot support is scraped on the floor.

In order to prevent the user from having to descend a step when brought into standing position, and to avoid friction of the user on the mattress, when the multi-position support apparatus reaches a predefined angle, the processor 20 may be programmed such that the movable foot support 17 starts to come down so that the feet of the user are in close proximity to ground level.

Figure 2:
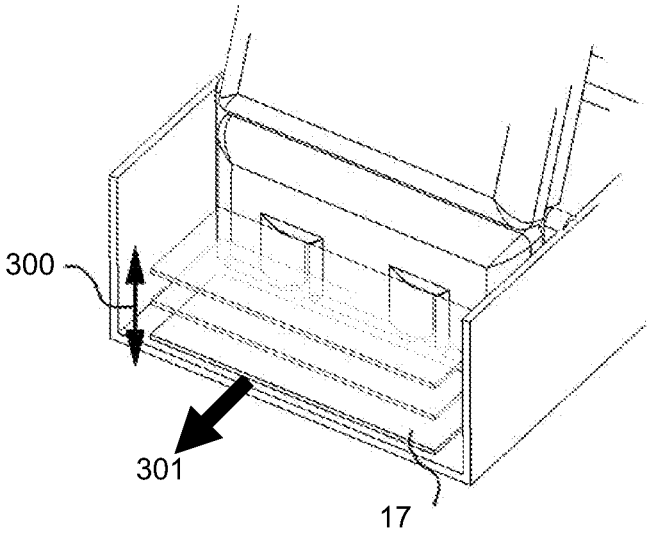
FIG. 2 is an illustration of a movable foot support in accordance with one embodiment of the present invention.
Figure 3:
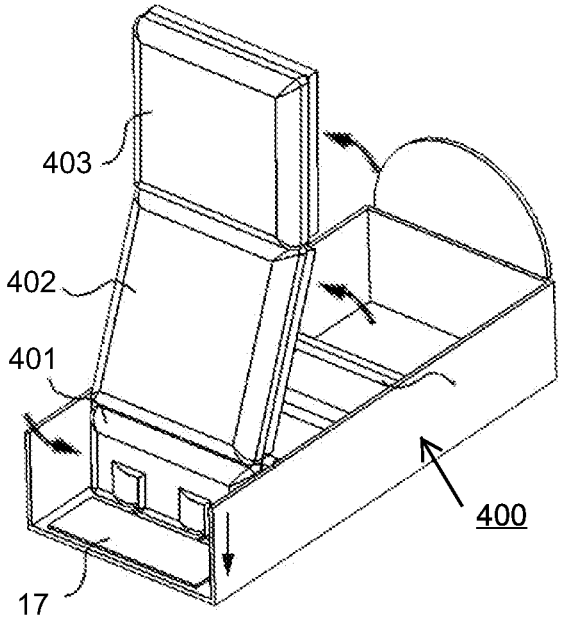
FIG. 3 is an illustration of a multi-position support apparatus featuring a movable foot support in accordance with the embodiment of FIG. 2.
Figure 4:
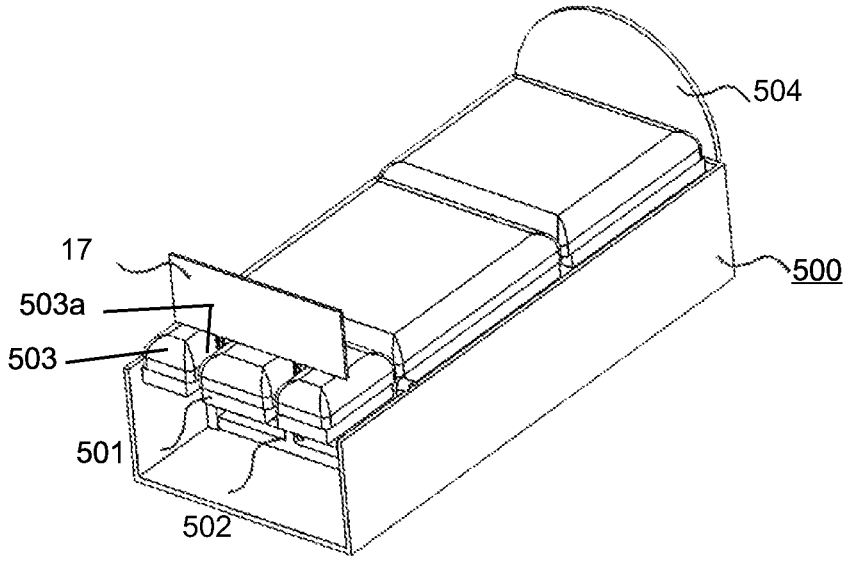
FIG. 4 is another illustration of the multi-position support apparatus featuring a movable foot support in accordance with the embodiment of FIG. 2.

FIGS. 2-4 illustrate an embodiment wherein the engine of movable foot support 17 may be positioned either underneath the multi-position support apparatus or on the side of the multi-position support apparatus along axis 300 or 301 (FIG. 2) and is connected to its operating engine through slots in a mattress, whereas FIGS. 10-14, described below, illustrate an alternative embodiment wherein the movable foot support 17 is connected to its operating engine using at least one arm-like extension reaching out from at least one side of the multi-position support apparatus. In this alternative embodiment it is not required that the mattress be slotted.

In either embodiment, the bed may also be used as a chair and may be moved into a sitting position, like a TV recliner.

FIGS. 3 and 4 schematically illustrate the vertical exiting position (FIG. 3) and horizontal resting position (FIG. 4) of the apparatus, schematically identified as 400 and 500, respectively, (and frequently refer to as "bed" for conciseness, in accordance with the preferred embodiments. FIG. 3 shows the foot support 17 extending transversely across the foot end of the body support received on this tiltable frame assembly 401. The body support includes a pivotally-mounted back section 402 and a pivotally mounted head section 403 occupied by the foot support. FIG. 4 schematically shows that in this embodiment, the foot support 17 is able to move towards the head end of the bed when the bed is in positions other than standing (FIG. 3), and towards the ground when the bed is in standing position FIG. 4 schematically shows the body support received on the tiltable frame assembly, therein indicated at 501 and 502, respectively, as receiving a mattress 503 formed with slots 503*a* extending for a short distance longitudinally of the body support towards the head end 504 of the bed. The mattress is equipped with means for it to be attached to the bed such as nails, screws, hooks, press-studs, strips, and strips with Velcro.

In one embodiment, at least one safety bracket, optionally coupled to a micro-switch or other sensor, ensures that the user may move around the bed safely. Optionally, the bed controller (processor 20, FIG. 1) sets the safety bracket state as function of the user's position.

In one embodiment, the bed is equipped with a toilet bowl. Optionally, when the toilet bowl is being used, the bed shifts to a sitting position. Optionally, the toilet bowl usage is indicated by the user via a control panel (not shown in the figures).

In one embodiment, a foldable tray is attached to the multi-position support apparatus. The foldable try may be used as a base for placing various objects such as food, drinks, dishes, books, a remote control, a telephone, a computer, an alarm clock, etc. The foldable tray may be folded in any way known in the art. To prevent objects placed on the foldable tray from falling down, as the multi-position support apparatus is changing its angular position, the foldable tray may be moved aside either manually by the user, or by an engine powered by any means known in the art.

In one embodiment, the bed may be raised vertically (i.e. up and down). The ability to raise the bed vertically is useful and convenient for when a user is receiving ambulatory treatments, physical examinations, getting therapy, massage, and/or any other treatments known in the art. By raising and lowering the bed, the bed's height may be adjusted to the height of the caregiver.

In one embodiment, the bed's armrests are not fixed to any moving parts of the bed. Thus, the user may place a blanket or any other object on the armrests before the bed is shifted from one position to another, without the object falling from the arm rests. Optionally, the bed includes a special shelf and/or tray on which various objects may be placed so that they will not fall down when the bed shifts from one position to another.

In the following description of the device, included are only main or principal details needed for sufficiently understanding proper 'enabling' utilization and implementation of the disclosed device. Accordingly, descriptions of the various required or optional minor, intermediate, and/or, sub systems, which are readily known by one of ordinary skill in the art, which are available in the relevant prior art and technical literature.

As indicated earlier, a multi-position support apparatus 10 constructed according to the present invention comprises the following: back support 11, back-seat angle 13, seat 14, seat-leg angle 15, leg support 16, movable foot support 17, base 19, a hand support 12 and leg-foot angle 18. It further comprises the back-seat angle 13, seat-leg angle 15, and leg-foot angle 18, each featuring a pivot, as known in the art. FIG. 3 illustrates an embodiment featuring back support 403, seat 402, seat-leg angle 401, and leg support featuring movable foot support 17. Multi-position support apparatus 10 uses engines to change its angular position under the control of a processor, schematically indicated at 20 in FIG. 1. For decorative or space-saving purposes, the multi-position support apparatus 10 may be designed with all or most of the engines controlling its angular position concentrated beneath seat 14.

In one embodiment, the angles of the multi-position support apparatus 10 are programmed, via processor 20, so that the user returns to the standing position with maximum stability; slightly reclined. Because of its slightly reclined angle in a standing position, the multi-position support apparatus 10 does not throw the user off-balance. It is to be noted that the term "reclining" may be interpreted as "backward inclining". All the angles of the multi-position support apparatus 10 may be pre-programmed in processor 20 to prevent the user from getting to predefined positions.

Figure 7:
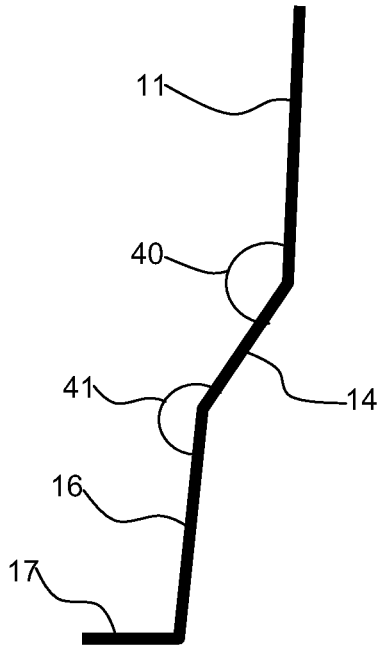
FIG. 7 is an illustration of one angle in accordance with the present invention.

FIG. 7 illustrates an example of the angles of multi-position support apparatus 10 in standing position. Either in a standing position or when entering a standing position, angle 41 is larger than 180 degrees in order to prevent the user from falling. Angle 40 should be smaller than 180 degrees, but not smaller than a predefined angle, which is dependent on the angular position of multi-position support apparatus 10 in its entirety. The control processor 20 is programmed to prevent the user from manually reducing angle 40 beyond an angle wherein exists the possibility that the user will fall forward from the multi-position support apparatus. By using the disclosed embodiments, the probability of accident is reduced. Receiving the user from a standing position—and returning the user to a standing position—minimizes the probability of bed-related accidents occurring.

The disclosed embodiments are also useful for people who cannot stand. In that case, the device is receiving the user from a sitting position—and returning the user to a sitting position.

A fast angular change may cause dizziness in elderly people, for example as a result of orthostatic hypotension. Optionally, the speed at which multi-position support apparatus 10 changes its angular position may be controlled and adjusted via processor 20 for the comfort and health condition of the user. Optionally, when the angular position changes, it is possible to stop the apparatus by using the control panel or any other controlling device. As indicated above, during the transition from laying position to standing position, elderly people might suffer from orthostatic hypotension and may feel weakness, muscle tonus decrease, and even possibly faint. Muscle tonus decrease during transition to standing position may result in the user falling off the bed. During the transition from laying position to standing position, the user may be leaned against the bed until the user is standing. Processor 20 can be programmed to reduce the danger in loosing muscle tonus, slipping down or to the side of the bed, and even falling forwards.

In one embodiment, in order to recognize muscle tonus decrease and prevent the falling, the bed features a muscle tonus monitoring device. Muscle tonus monitoring may be achieved by various devices known in the art. Processor 20 can be programmed such that the muscle tonus monitoring device detects a critical reduction in user's muscle tonus, the bed automatically brings the user back to a safe reclining position. Optionally, movable protective barriers may be motorized so as to be raised on the sides of the bed, thus preventing the user from slipping to the side.

The processor 20 may be programmed to control the drive motors 21, 23, 24, 25 (FIG. 1) such that movable foot support 17 pushes the user's feet forward by moving on axis 301 as illustrated in FIG. 2. Thus, legs of the user are used as a lever and prevent the user from falling forward. Moreover, the lever effect helps to lean the body of the user against the bed. Optionally, the user's knees are pushed forward, resulting in knees bending. Along with the feet, which are pushed forward, the user is brought to a safe position. The knees and feet are pushed forward, rather than the body of the bed is brought backward. Thus, the bed fully supports the body of the user, keeping constant contact with the user. Keeping constant contact with the user and no gap between the user's body and the bed reduces the probability of falling off the bed. Optionally, in seating position with legs up, the foot support moves forward out of the multi-position support apparatus, giving the legs the ability not to be bent to uncomfortable position. The multi-position support apparatus is gradually returning to reclining position, constantly keeping contact with the body of the user.

The multi-position support apparatus 10 illustrated in FIG. 1 is capable of entering into positions of standing, sitting and reclining. The engines may be connected to the various parts of the multi-position support apparatus 10. For example, the engines may be connected to the back support 11, seat 14, and leg support 16. In another optional embodiment (not shown in the figure), the engines may be connected to the device's pivots. For example, two engines may be connected to the back-seat angle 13 and the seat-legs angle 15.

Processor 20 may be programmed to change the angle of back support 11, seat 14, and leg support 16, in a manner to achieve maximum stability and put minimal pressure on the legs. As one example, the user enters the apparatus in a standing position, leans backwards, and upon achieving a reclined angle of 20 to 60 degrees, whereupon the apparatus begins to move the user into a sitting position. When the apparatus moves from sitting to standing the user is first brought to an inclined position of between 20 and 60 degrees, and only then is brought to a full standing position.

In one embodiment, one or more sensors are placed in the foot support 17, or on the foot support 17, or in other possible locations. The sensors may be used for preventing a situation in which the multi-position support apparatus 10 descends on the foot of an operator who is not the user, such as a nurse. The one or more sensors detect objects and prevent foot support 17 from crushing them. Examples for optional sensors are, but are not limited to, infra-red sensor, electric footboard that sends a signal when it is stepped upon, micro switch, camera, or any other sensor known in the art.

In one embodiment, one or more sensors are placed in or on back support 11. The one or more sensors prevent a situation in which back support 11 crushes an operator who is not the user, such as a nurse, by detecting objects and prevent back support 11 from crushing them. Examples for optional sensors are, but are not limited to, infra-red sensor, electric footboard that sends a signal when it is stepped upon, micro switch, camera, or any other sensor known in the art.

In order to achieve a reclining position (180 degrees), it is possible to create an indentation in the pivot area so that the pivot will fall into the indentation when the multi-position support apparatus is stretched, as required for a reclining position.

Optionally, one embodiment of the armrests of the multi-position support apparatus may move up, down, and to the sides, to enhance the user's comfort. Optionally, the armrest may be detached from the multi-position support apparatus. In this case, when the multi-position support apparatus moves, the armrests are not moving along with it, to allow the user to comfortably reach for an object or shelf during changes in position.

Figure 8:
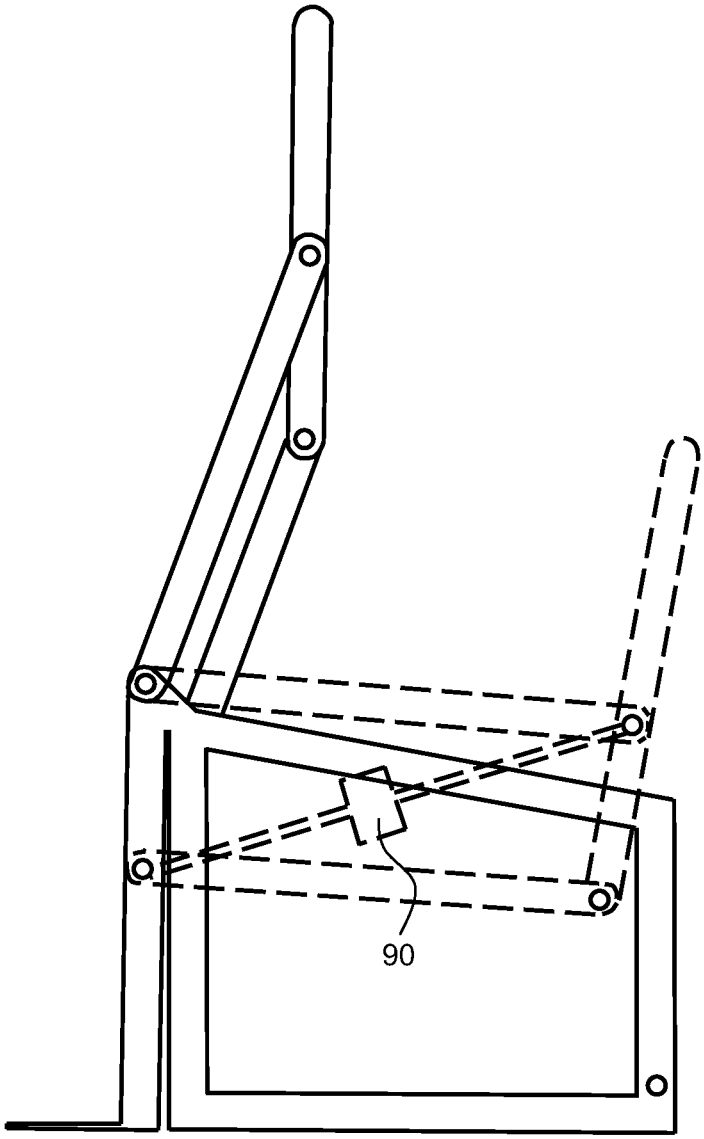
FIG. 8 is another illustration of a multi-position support apparatus featuring one engine in accordance with the present invention.
Figure 9:
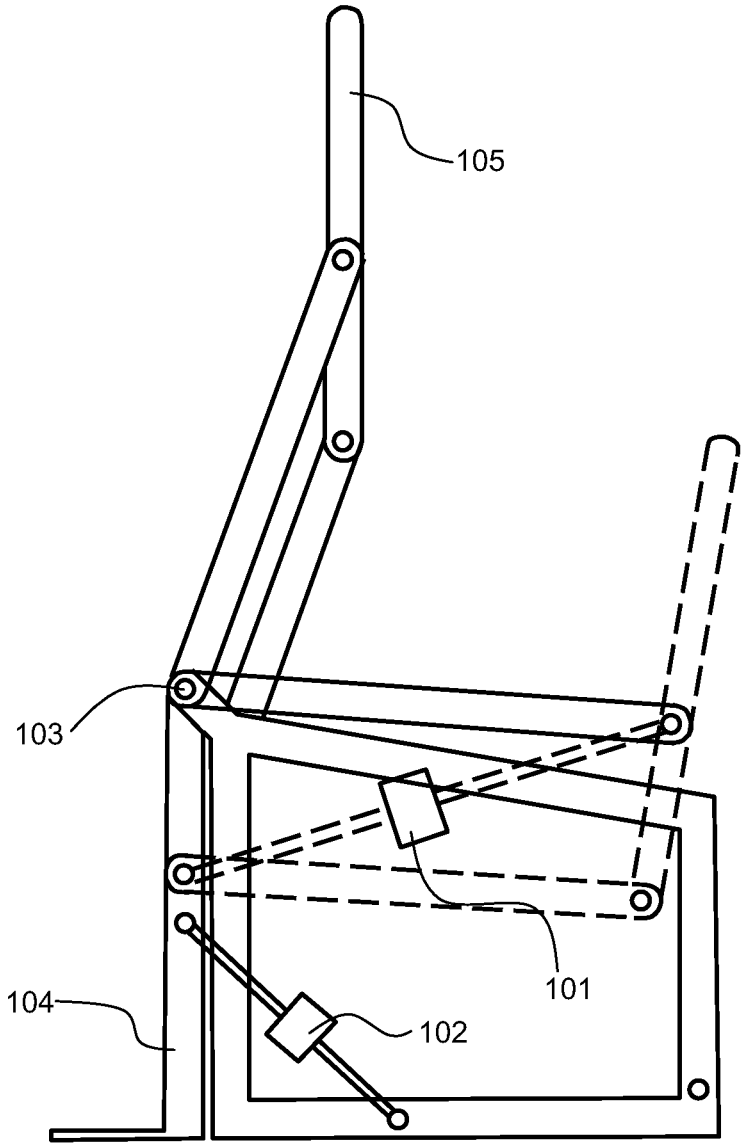
FIG. 9 is an illustration of a multi-position support apparatus featuring two engines in accordance with the present invention.

FIG. 8 illustrates a parallelogram-based structure with one engine 90 which enables the multi-position support apparatus to shift from a standing position to a sitting position or from a sitting position to a reclining position. Engine 90 operates a rod that can decrease or increase in length. When the rod's length grows, the device shifts to a reclining position. The leg-support and back-support move nearly together and therefore one engine may be used for both. FIG. 9 illustrates a parallelogram-based structure device with two engines. The operation of the first engine is identical to that of the parallelogram-based structure device with one engine. Operation of the second engine raises and lowers the device. 101 is an engine for shifting from a sitting to a standing position. The apparatus is fixed to axis 103. The purpose of engine 102 is to shift the apparatus from a sitting to a lying position. It is to be noted that in the parallelogram-based structure device, 104 and 105 are parallel and move in tandem. In a non-parallelogram-based structure device, it is sometimes possible to control each of the parts independently or almost independently.

Figure 10:
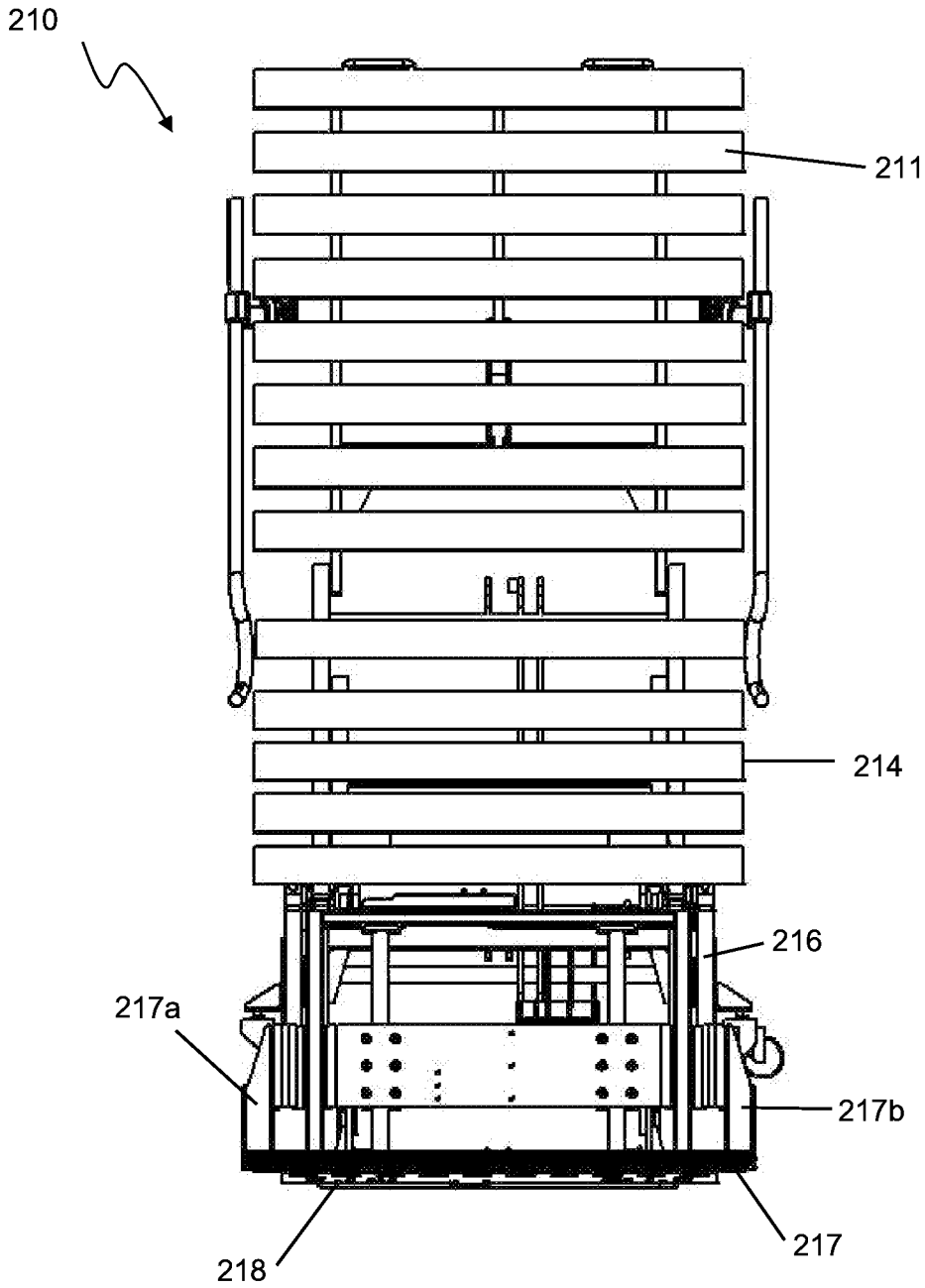
FIG. 10 is a front view illustration of another embodiment of a multi-position support apparatus in standing position.
Figure 11:
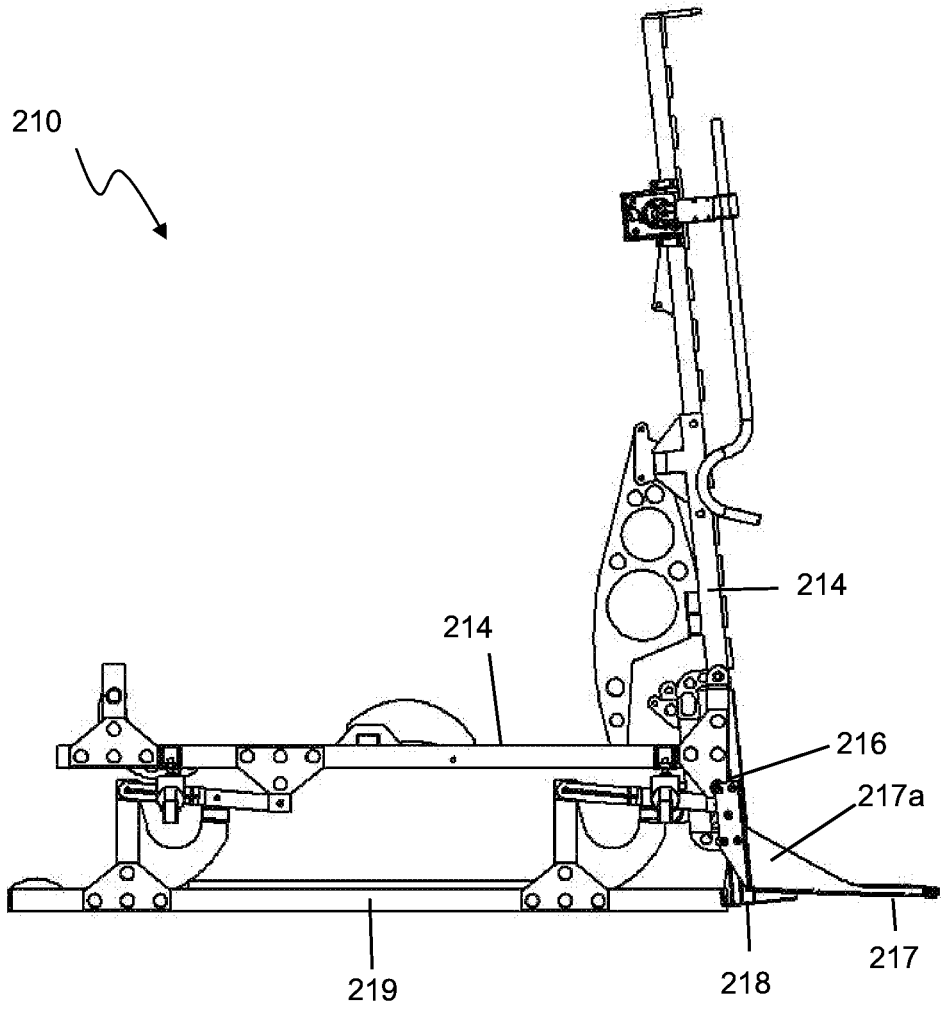
FIG. 11 is a right view illustration of the FIG. 10 embodiment of multi-position support apparatus in standing position.
Figure 12:
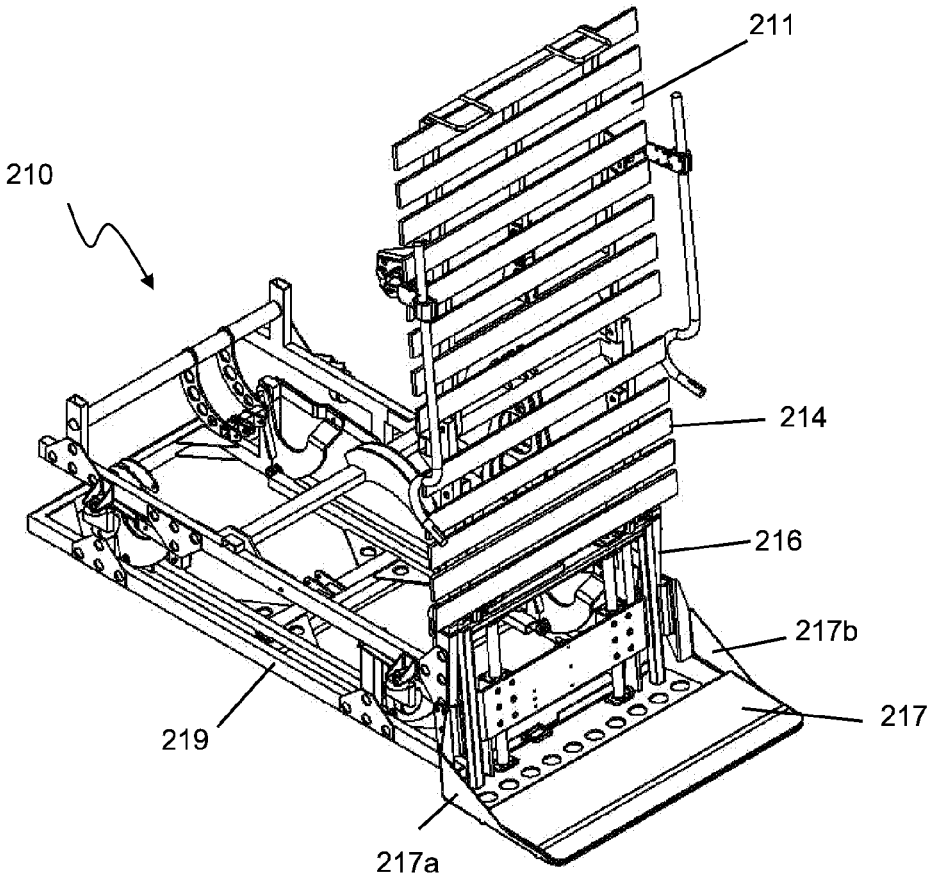
FIG. 12 is an isometric view illustration of the FIG. 10 embodiment of multi-position support apparatus in standing position.
Figure 13:
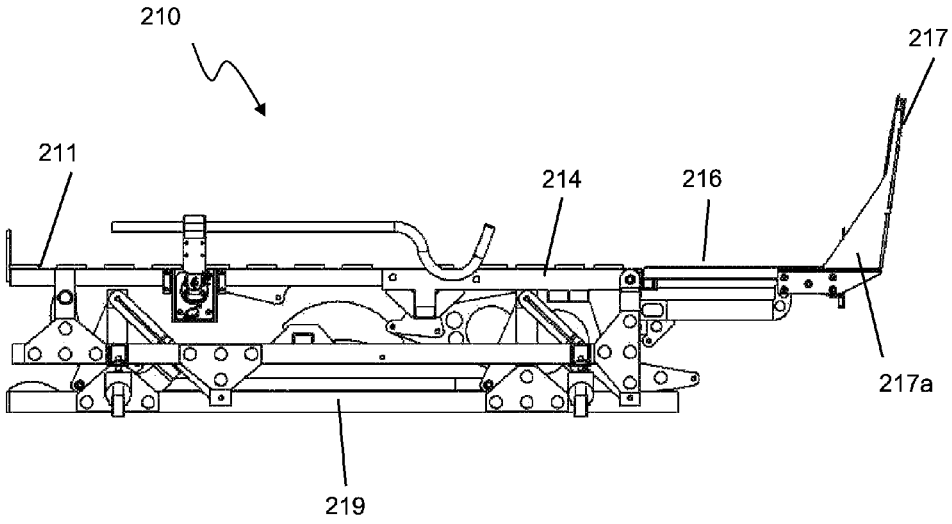
FIG. 13 is a side view illustration of the FIG. 10 embodiment of multi-position support apparatus in lying position.
Figure 14:
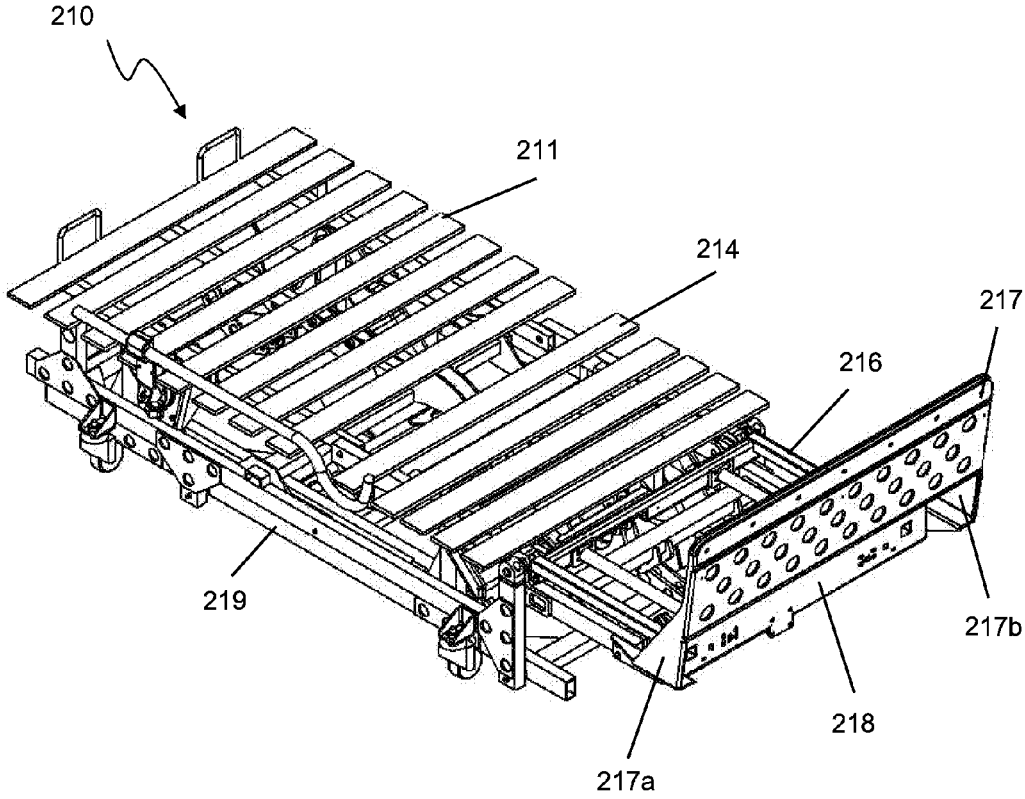
FIG. 14 is an isometric view illustration of the FIG. 10 embodiment of the multi-position support apparatus in lying position.

FIGS. 10-14 illustrate another, non-limiting, embodiment of the multi-position support apparatus constructed according to FIG. 1, but omitting the processor 20 and the drivers controlled thereby. FIG. 10 is a front view illustration of the multi-position support apparatus, therein designated 210, in standing position; FIG. 11 is a right view illustration of the multi-position support apparatus 210 in standing position; FIG. 12 is an isometric view illustration of the multi-position support apparatus 10*a* in standing position; FIG. 13 is a side view illustration of the multi-position support apparatus 210 in lying position; and FIG. 14 is an isometric view illustration of the multi-position support apparatus 210 in lying position. Briefly, apparatus 210 illustrated in FIGS. 10-14 also includes: a body supporting member constituted of head section 211, seat section 214, and leg section 216 of a tiltable frame assembly mounted on a base 219 for supporting a user in a selected position, and a foot support 217 extending transversely across the foot end 218 of the body support, as in the previously described embodiments. In this embodiment, however, the foot support 217 is movably mounted relative to the foot end 218 of the body support by a pair of arms 217*a*, 217*b* mounted to opposite sides of the body support. The structure and operation of the apparatus of FIGS. 10-14 are otherwise the same as the other illustrated embodiments.

FIG. 1 illustrates the drive means controlled by processor 20 as including the three engines 23, 24, and 25 setting the angular position of multi-position support apparatus 10. The use of three or more engines to control the angular position of the multi-position support apparatus 10 enables further adjustment of the movement of the multi-position support apparatus 10, for the comfort of the user. The multi-position support apparatus 10 may include more than three parts where each part may feature a separate engine.

For example, the multi-position support apparatus 10 may have different lengths to cater to users of various heights. Therefore, the length of the multi-position support apparatus 10 should be adjusted to the height of the user. Adjustment of multi-position support apparatus 10 to the user's height may be accomplished by controlling the lengths of leg-support 16 and back-support 11.

Figure 5:
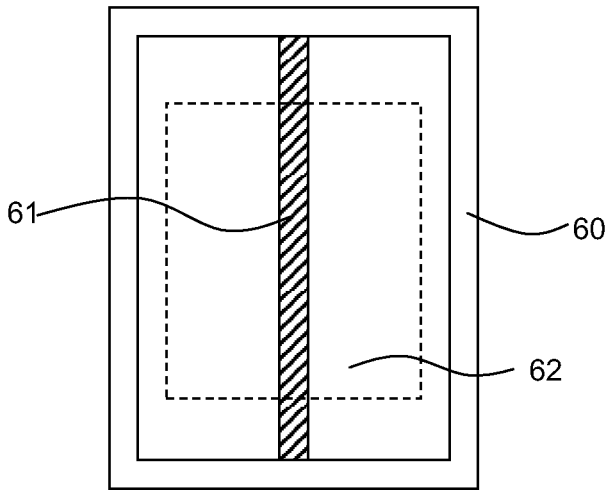
FIG. 5 is an illustration of floating back support in accordance with the present invention.

In the embodiment wherein the multi-position support apparatus 10 is with mattress 503, FIG. 4, when the multi-position support apparatus 10 shifts from sitting position to reclining position, the user's body may slide down. This motion may cause uncomfortable friction to an unclothed body. To prevent the friction, it is possible to program processor 20 to cause the multi-position support apparatus 10 to move according to the motion of a user. For example, enabling the back of the bed to move according to the motion of a user's back. Referring to FIG. 5, the back support 62 is floating over the back-support frame 60. In one embodiment, the floating of the back support 62 over the back-support frame 60 is achieved by slides 61. In an optional embodiment, one or more of the following parts may be floating parts: head support, back support, and leg support.

According to another option, the floating is achieved by using the following optional embodiments: (a) Two or more tracks. Hereinafter, the term "track" refers to any device that enables movement along a specific direction. (b) Using a spring to hold the floating part in place for ensuring that the floating part does not move independently. To prevent quick movement by the spring it is possible, for example, to integrate the spring with a piston. (c) Using a telescopic device. An exemplary telescopic device is shock absorbers such as those used in motorcycles or automobile luggage compartments (trunks). The functionality of the telescope device is to ensure that the support is not moving by itself and/or not moving independently when the user momentarily gets up. The use of a telescopic device is just an example and floating parts may be implemented with any other device known in the art. As long as no command is given to change the angular position of the multi-position support apparatus 10 and/or as long as the engine is idle, the floating part's position on the slide is fixed. This may be achieved by using a pin, step motor, electro-magnet, etc. In this case, the telescopic device is not needed, as the floating part is not moving independently. The floating device moves along at least one track. Examples of optional track configurations include a track down the middle, two tracks down the sides of the back-support, or any other equivalent implementation.

Optionally, instead of using a floating device, the movement may be achieved by using an engine. The control commands to the engine may be derived from measuring in advanced the distance the user's back should move as function of the angular position of the chair/apparatus.

The starting positions of the floating parts may be determined according to the specific user's height. In that case, the multi-position support apparatus adjusts to different heights of users by moving the floating parts' positions according to the user's height. The taller a person is, the further apart the floating parts' starting position is in the apparatus' standing position.

Hereafter the floating parts of the multi-position support apparatus embodiment are described. Referring to FIG. 1, parts 11 and 14 are nearest to one another in a standing position. For example, in order to prevent uncomfortable friction when the apparatus changes its angular position, parts 11 and 14 move closer together as the apparatus shifts from a sitting to a reclining position. Another option is using floating parts without active control that are laced on a slide. When the user sits, parts 11 and 14 move away from one another. When the user lies down, parts 11 and 14 move closer together. To sum up, when shifting from a standing to a sitting position the parts should move away from each other, and when shifting from sitting to reclining the parts should move closer.

The example of the floating-parts solution may be implemented on any of the users' body supporting parts, including the backseat and leg supports. Because relative movement is needed, it may be sufficient that only the back-support part and/or the leg-support part be floating. In this case, it is not necessary for the seat to move, because the back-support and/or leg-support are moving.

In one embodiment, a feces-collecting device, referred to herein as "integrated toilet", may be integrated into the multi-position support apparatus 10. The integrated toilet features significant hygienic advantages. Examples of integrated toilets include a toilet, toilet bowl, and lavatory seat.

There are cases where there is a need to secure the user to the multi-position support apparatus 10. For example, when the user is an elderly person suffering from Alzheimer's disease, dementia or amnesia. The user may be secured to the device using any means known in the art. For example, multi-position support apparatus 10 side-handles that close-in/wrap the user and hold the user in place, and/or support straps attached to the sides of the multi-position support apparatus 10.

Figure 6:
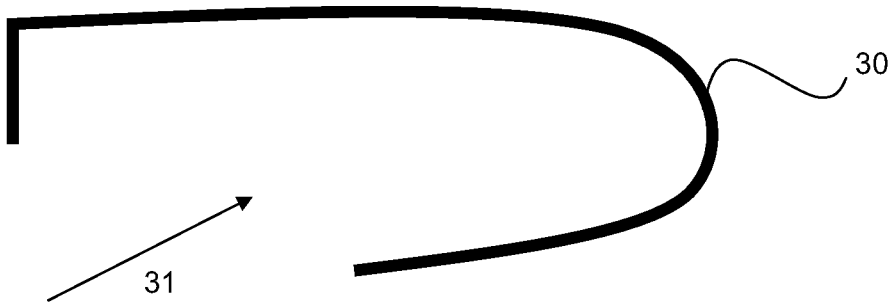
FIG. 6 is an illustration of an arm rest in accordance with the present invention.

FIG. 6 is an illustration of armrest 30, which enables a user to enter the multi-position support apparatus 10 from a comfortable and safe direction 31. Entering multi-position support apparatus 10 comfortably is achieved using two handles, armrests, or hand supports, featuring different lengths. On one side, a short handle allows easy entry into the device; on the other side, a long handle both supports the user and prevents the user from falling from the apparatus. Moreover, the user may be secured at the knees while standing, to increase safety and stability.

In one embodiment, it is possible to control the operation of the device by one or more means of the following options: (a) Operating the device using a control button that enables choosing the desired program. (b) Operating the device using a controller that identifies voice commands. (c) Automatic operation of the device by means of user-identification. (d) Identifying the user may be achieved by any method known in the art. For example: by means of voice or visual aids, RFID, smart card, key, user's weight, control panel, etc.

After the device identifies the user, a personalized program may be executed. Angles and velocities are examples of some of the parameters which may be saved in the personalized program.

In one embodiment, the device is operated manually. The manual operating program activates each step/stage according to instructions from either the user or any other human operator. Alternatively, the device is operated by an automatic program that activates all stages, sequentially. Alternatively, the device is operated by one of the following, or by a combination thereof: (a) the user, (b) an operator who is not the user, (c) from any place where it is possible to control the device's operations via remote control or any other remote operating means as known in the art, or, (d) automatically, using methods known in the art.

In one embodiment, prior to executing the program, the device activates a voice indicator which informs the user about the program to be executed. The program is activated only after the user confirms the voice-indication. The user may confirm execution of the program by any input means known in the art, such as pressing a confirmation button, or by voice-command.

In one embodiment, the device features an interface from which a variety of operations are controlled. For example, the controller may be operated by the following means: manual, keyboard, voice-activation, computer-connected, for example via RS232 or USB, remote activation such as by telephone or wireless network, or by any other means known in the art. In one embodiment, all or some of the parameters that have been user-customized, such as user programs, angles, heights, and angular change velocity, are pre-programmed Parameters customized for the user may be saved in the device or in any computer, or memory element, capable of communicating with the bed.

In one embodiment, the device features a Built in Test (BIT). The BIT system may be used for fast identification of failures. This capability enables a technician to determine what action should be taken. The BIT also makes it easier to provide price quotes to a user prior to responding for repairs. Optionally, the BIT results may be transferred to the technician's equipment via a phone line or wireless network, or any other known in the art communication aid.

In one embodiment, when installing the device at the user's site, the technician is able to set a combination of velocities, movement angles, and other parameters referred to herein as "operational customized parameters" of the device such that it is possible to fit the use of the device to the requirements, comfort and safety of the specific user. Optionally, the operational customized parameters are saved in a memory element for future use.

In an emergency, the bed may operate a predefined emergency response operation, such as, but not limited to, bringing the user to a predefined angular position. The angular position, into which the user is brought in an emergency, may the most secure angular position for the specific user. Entering the emergency response operation may be initialized by any kind of appropriate device, such as, but not limited to, emergency button, emergency pull-rope, voice command, and etc.

The embodiments of the present invention are not limited to the details of the order or sequence of steps of operation or implementation of the embodiments and corresponding method set in the description, drawings, or examples of the embodiments of the present invention.

Citation or identification of any reference in this application shall not be construed as an admission that such reference is available as prior art to the embodiments of the present invention.

While the invention has been described in conjunction with specific embodiments and examples thereof, it is to be understood that they have been presented by way of example, and not limitation. Moreover, it is evident that many alternatives, modifications and variations will be apparent to those skilled in the art. Accordingly, it is intended to embrace all such alternatives, modifications and variations that fall within the spirit and broad scope of the appended claims and their equivalents.

What is claimed is:

1. Apparatus for supporting a user in a resting position and/or a vertical exiting position, comprising:

a tiltable frame assembly tiltably mounted on a base;

a body support carried by said tiltable frame assembly and having a head end for receiving the upper part of the user's body, and a foot end for receiving the lower part of the user's body;

a foot support extending transversely across the foot end of the body support;

and drive means for driving said tiltable frame assembly to said resting position and to said substantially vertical exiting position;

characterized in that said apparatus further comprises a processor programmed to cause headward movement of the foot support, thereby engaging the bottom surface of the user's feet, when the tiltable frame assembly is in said resting position, and to maintain said feet-engaging position while the tiltable frame assembly is moving towards said vertical position, to thereby prevent sliding of the user's body when the tiltable frame assembly is tilted.

2. The apparatus according to claim 1, wherein said foot support includes a foot sensor which senses said feet-engaging position of the foot support and controls said drive means to maintain the foot support in said feet-engaging position while said tiltable frame assembly is moving towards said vertical position.

3. The apparatus according to claim 1, wherein said resting position includes a substantially horizontal position.

4. The apparatus according to claim 1, wherein said resting position includes a seating position.

5. The apparatus according to claim 1, wherein the apparatus further comprises a lifting mechanism between said base and said tiltable frame assembly for selectively supporting the user also in an elevated position.

6. The apparatus according to claim 1, wherein said foot support is fixed to said tiltable frame assembly to overlie the foot end of said body support, and said body support is driven by said drive means to said feet-engaging position.

7. The apparatus according to claim 6, wherein said foot support is fixed to said tiltable frame assembly by a pair of arms fixing opposite sides of the foot support to said tiltable frame assembly.

* * * * *